US006551476B1

(12) United States Patent
Scherba

(10) Patent No.: US 6,551,476 B1
(45) Date of Patent: Apr. 22, 2003

(54) NOBLE-METAL COATED INERT ANODE FOR ALUMINUM PRODUCTION

(76) Inventor: Emil S. Scherba, 3100 Teranimar Dr., Anaheim, CA (US) 92804

( * ) Notice: Subject to any disclaimer, the term of this patent is extended or adjusted under 35 U.S.C. 154(b) by 0 days.

(21) Appl. No.: 10/042,111

(22) Filed: Jan. 8, 2002

(51) Int. Cl.[7] ..... C25B 11/04

(52) U.S. Cl. ..... 204/292; 204/293; 204/280; 204/243.1; 204/247.3

(58) Field of Search ..... 204/243.1, 247.3, 204/292, 293, 280

(56) References Cited

U.S. PATENT DOCUMENTS 6,372,099 B1 * 4/2002 Duruz et al. ..... 204/245
6,402,928 B1 * 6/2002 De Nora et al. ..... 204/247.3
6,436,274 B2 * 8/2002 De Nora et al. ..... 204/243.1

* cited by examiner

*Primary Examiner*—Bruce F. Bell
(74) *Attorney, Agent, or Firm*—Walter Unterberg

(57) ABSTRACT

This invention is an inert, non-consumed, anode for use in electrolytic production of aluminum from the ore, consisting of a plurality of parallel vertical wires, or rods, attached to a suspended support structure which is also connected to an electrical power source. The wires are made of a high-temperature corrosion-resistant alloy and are durably surface-coated with a noble metal such as platinum, typically deposited by the SCX sputter coating process. In operation the coated wires are immersed in a fused fluoride electrolyte bath at 900 C., but remain structurally intact at that temperature. Moreover, the catalytic noble-metal surface dissociates the oxides formed in the electrolysis, avoiding generation of greenhouse gases. To suit the dimensions of the electrolytic furnace, the inert anode can be expanded in the form of linear or circular modules of the coated wires or rods. The power consumption with the inert anode of the invention is half that with a carbon anode.

14 Claims, 5 Drawing Sheets

NOBLE-METAL COATED INERT ANODE FOR ALUMINUM PRODUCTION

BACKGROUND OF THE INVENTION

1. Field of the Invention

This invention relates to anodes used in the electrolytic extraction of aluminum metal from alumina (aluminum oxide) ore. In particular, it relates to inert anodes with noble-metal coatings.

2. Related Art

The most widely used process in commercial aluminum production is the Hall-Heroult process which utilizes an electrolytic furnace in which the electrolyte is a bath of fused fluorides and cryolite at typically 900 deg C. The cathode is carbon which lines the vertical walls and bottom of the furnace. The anode consists of vertical carbon bars which dip into the bath.

Powdered alumina ore is dropped into the bath from above and an electric current is passed through the bath via cathode and anode. The resulting electrolysis separates out pure aluminum metal at the cathode (where it is periodically tapped), and oxygen at the anode which it attacks, consuming the carbon anode to form carbon monoxide and carbon dioxide. The anode consumption rate is roughly equal to the aluminum production rate.

To avoid the continuous replacement of carbon anodes and the emission of greenhouse gases such as carbon dioxide, a search has been undertaken for an inert non-carbon anode which can withstand the corrosivity of the high-temperature salt bath, is not attacked and consumed by the oxygen, and yet has high electrical conductivity.

One class of materials considered has been advanced ceramics such as refractories, monolithic ceramics, ceramic composites, and coatings.

Two comprehensive reports on the subject have been published:

1. "Inert Anode Roadmap—A Framework of Technology Development" published by Energetics, Inc., Columbia, Md. (February 1998);
2. "Report of the ASME's Technical Working Group on Inert Anode Technologies" published by American Society of Mechanical Engineers (July 1999).

Ref.1 established essential performance targets for inert anodes, such as: low erosion rate, high electrical conductivity, low polarization voltage, good structural properties, stability in high-temperature oxygen, good metal quality, and environmental and safety acceptability. After reviewing the state of the art, Ref.1 states that "a viable material for fabricating the anodes has not yet been demonstrated".

Ref.2 "provides a broad assessment of,open literature and patents that exist in the area of inert anodes . . . ". A patent search uncovered more than 119 patents going back to 1985 and a further 229 patents going back to 1945. Progress in inert anode materials was found, such as cermets of nickel-iron-copper and self-passivating metallic alloys. However, for practical applications "to date, no fully acceptable inert anode materials have been revealed". Recommendations for future R&D resulted in a first priority for metals protected with coatings. One of the industry experts doubted that micron-thin noble-metal coatings would remain intact on metallic substrates.

Contrary claims have been made in the noble-metal coating field for the SCX low-temperature sputter coating process which is computer-aided and proprietary to Englehard-CLAL, Carteret, N.J. As described in the article "Unique Coating Technology Enables Co-Deposition of Noble Metals", Industrial Heating (October 1997), micron-thin platinum coatings were successfully deposited on metal wires of diameters as small as 10 mil (and even smaller) by this process.

OBJECTS OF THE INVENTION

In view of the related art described above, the following desirable characteristics are set forth as objects of a viable inert anode for electrolytic aluminum production:

1. Has high electrical conductivity, above that of carbon;
2. Generates anodic oxygen rather than carbon dioxide;
3. Has inert surface, making the anode non-consumable;
4. Has catalytic surface to promote dissociation of oxides in the electrolysis;
5. Made of material which remains solid at 900 deg C., considerably above the temperature of the electrolysis.
6. Has surface which resists corrosion when exposed to fused fluoride salts and molten aluminum metal;
7. Has modular geometry expandable to fit large furnaces; and
8. With production costs in a range which makes the inert anode economically viable for commercial application.

BRIEF SUMMARY OF THE INVENTION

To implement the above-stated objects the instant invention of an inert anode for electrolytic aluminum production has been devised.

The anode is of modular construction consisting of a plurality of parallel vertical wires mounted on horizontal support structure which may be: (1) linear and extensible to fit large furnaces, singly or in parallel; or (2) circular, singly or in multiple concentric circles. This geometry provides a high surface-to-volume ratio which supports efficient electrolytic action. The connection to an electric power supply is through the support structure.

The support structure and the wires, typically ⅛ inch in diameter, are made of a high-temperature corrosion-resistant metal alloy such as ASTM A297, ASTM A351, or AISI 330. These alloys are not attacked by fused salts or molten metals at the elevated temperature of the electrolytic bath.

The wires are completely surface-coated with a noble metal such as platinum to a thickness in the range of 1 to 10 microns. A durable noble-metal coating process such as the proven SCX sputter coating process or equivalent is used to attach the coating permanently to the wires.

The melting points of the metal alloy and the platinum are considerably above the bath temperature to ensure that the anode wires and manifolds remain in the solid state and structurally strong at all times. The corrosion-resisting and catalytic properties of the platinum ensure that the anode surfaces do not corrode, are not consumed, and able to dissociate any oxides formed in the process. Also, bare spots due to inadvertent handling nicks, bruises or abrasions are of no consequence for continuous electrolysis operation since the metal alloy base material is heat-resistant and also resists corrosion by molten fluoride salts.

The electrical conductivity of the metal wire anodes is of the order of four times higher than that of carbon, thus reducing the power input to the furnace, typically by a factor of one-half, compared to carbon anodes.

The physico-chemical characteristics of the inert anode of the invention described above give rise to the following economic and environmental advantages for electrolytic aluminum production as a whole:

1. Cost reduction due to lower electrical power requirement;
2. Higher productivity due to enhanced electrocatalytic action:
3. Environmentally clean industry due to zero emission of greenhouse gases, including perfluorocarbon gases;
4. Capital cost savings due to shutdown of carbon-making plants for anodes, even when offset by cost of replacement alloy and platinum anodes;
5. Higher quality aluminum metal due to reduced contaminants in extraction process; and
6. Application to electrolytic furnaces of variable size due to modular nature of anodes permitting linear or concentric expansion of anode surface.

BRIEF DESCRIPTION OF THE SEVERAL VIEWS OF THE DRAWING

A better understanding of the invention may be gained by reference to the following Detailed Description in conjunction with the drawings provided in which.

DETAILED DESCRIPTION OF THE INVENTION

Figure 1:
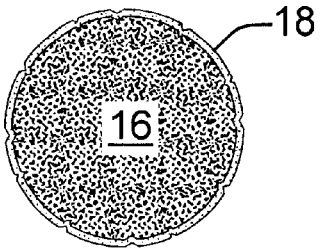
FIG. 1 is a micrograph cross-section (×100) of a titanium metal wire coated with a 50 micron platinum coating as manufactured.

Referring now to FIG. 1, there is shown a micrograph (×100) cross-section of a 0.017 inch diameter titanium wire coated with a 50 micron platinum coating as manufactured by the SCX process.

Figure 2:
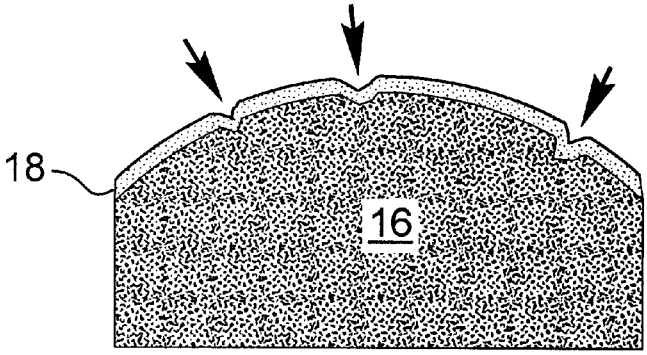
FIG. 2 is a micrograph cross-section (×300) of the coated wire of FIG. 1 as manufactured.

Referring now to FIG. 2, the same coated wire is shown in a higher magnification micrograph (×300). The platinum coating is seen to be intact even in the surface crevices indicated by the arrows, thus confirming complete coverage.

The coated wire of FIGS. 1 and 2 was used as anode in an electrolytic cell with a zinc sulfate electrolyte in an aqueous sulfuric acid solution and an aluminum cathode. After 17 hours of operation at 3.55 volts and a cathode current density of 20 amperes per square inch the coated wire anode was again micrographed.

Figure 3:
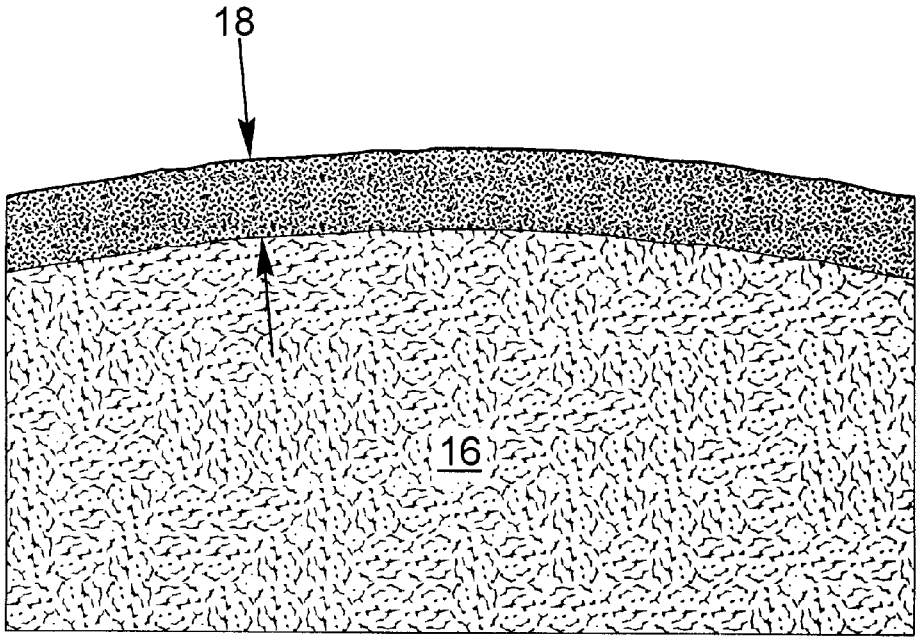
FIG. 3 is a micrograph cross-section (×200) of the coated wire of FIG. 1 after 17 hours service as an anode in an electrolytic cell with a sulfuric acid/zinc sulfate electrolyte.

The result is shown in FIG. 3, a micrograph with a 2000×magnification. It is seen that the platinum coating remained intact throughout the 17 hours of electrolysis. This evidence establishes the feasibility of the present invention—the use of noble-metal coated metal-alloy wires as inert anode material in eletrolytic aluminum production. The remaining Figures illustrate scaled-up configurations of the invention for application to full-scale electyrolytic furnaces.

Figure 4:
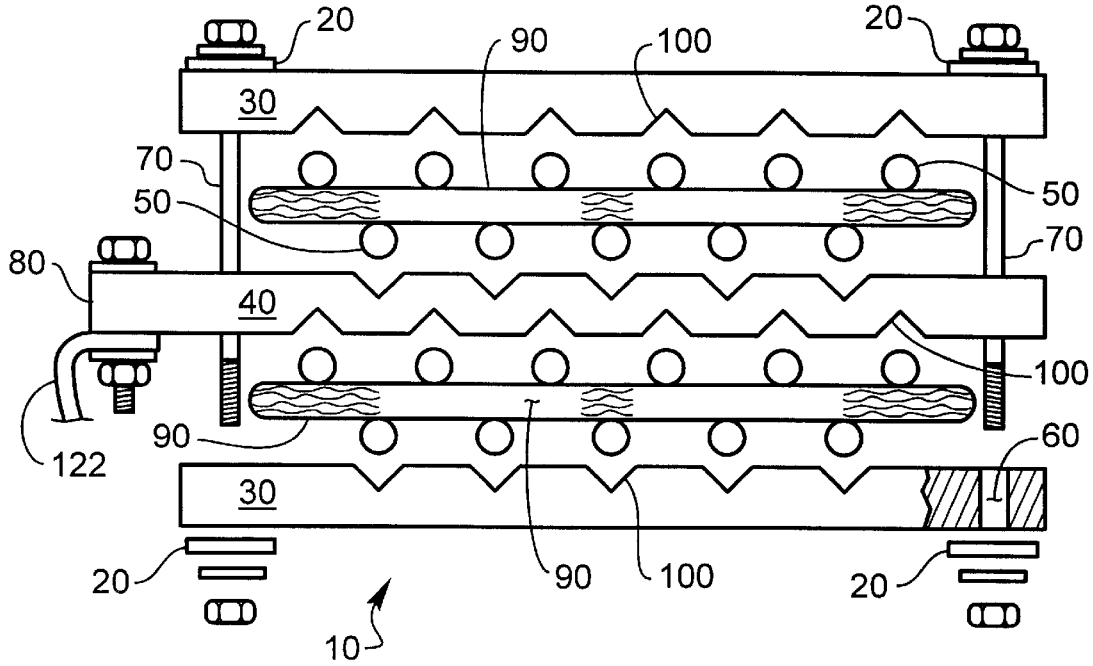
FIG. 4 is an exploded plan view of the linear configuration of the inert anode of the invention before final assembly.

Referring now to FIGS. 4–7, a modular linear configuration is illustrated. FIG. 4 shows an exploded plan view of a linear module 10 before final assembly. Staggered pairs of rows of vertical coated wires 50 are separated by compressible wire mesh pads 90. Each pair of rows of staggered coated wires 50 is separated from its neighboring pair by an inner clamping bar 40, and the two outermost coated wire rows are retained by two outer clamping bars 30.

Clamping bars 30 and 40 carry positioning notches 100 to receive wires 50 located next to clamping bars 30 and 40. All clamping bars 30 and 40 and all wire mesh pads 90 are compression supported by two bolt fasteners 70, one at each end, via bolt holes 60. The linear module is suspended by suspension attachments 20 which connect to bolt fasteners 70 at the ends of the two outer clamping bars 30 via fastening bolt holes 28, and to the external support system by support connections 32. The power input extension 80 brings electric power to linear module 10 via a central clamping bar 40.

Figure 5:
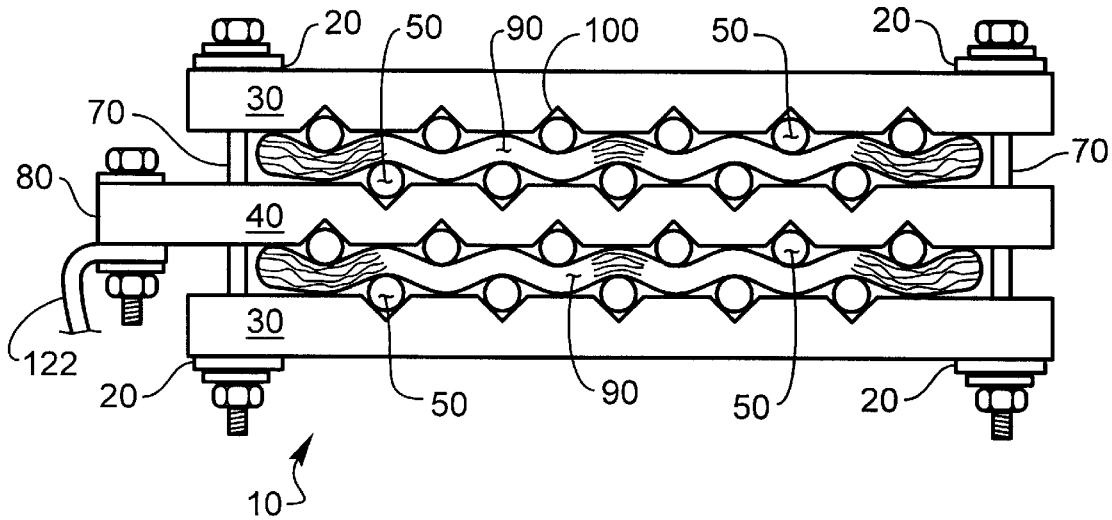
FIG. 5 is a finally assembled plan view of the linear inert anode configuration of FIG. 4.

Referring now to FIG. 5, the final assembly of linear configuration module 10 is shown. The callouts on FIG. 5 are identical to those on FIG. 4, but now bolt fasteners 70 have been tightened up to compress mesh pads 90 around all coated wires 50, also urging wires 50 into their designated positioning notches 100. This compression has now established complete electrical contact among all metallic components so that the electrical current introduced by power input 80 flows by conduction to the extreme reaches of wires 50 and into the electrolyte.

Figure 6:
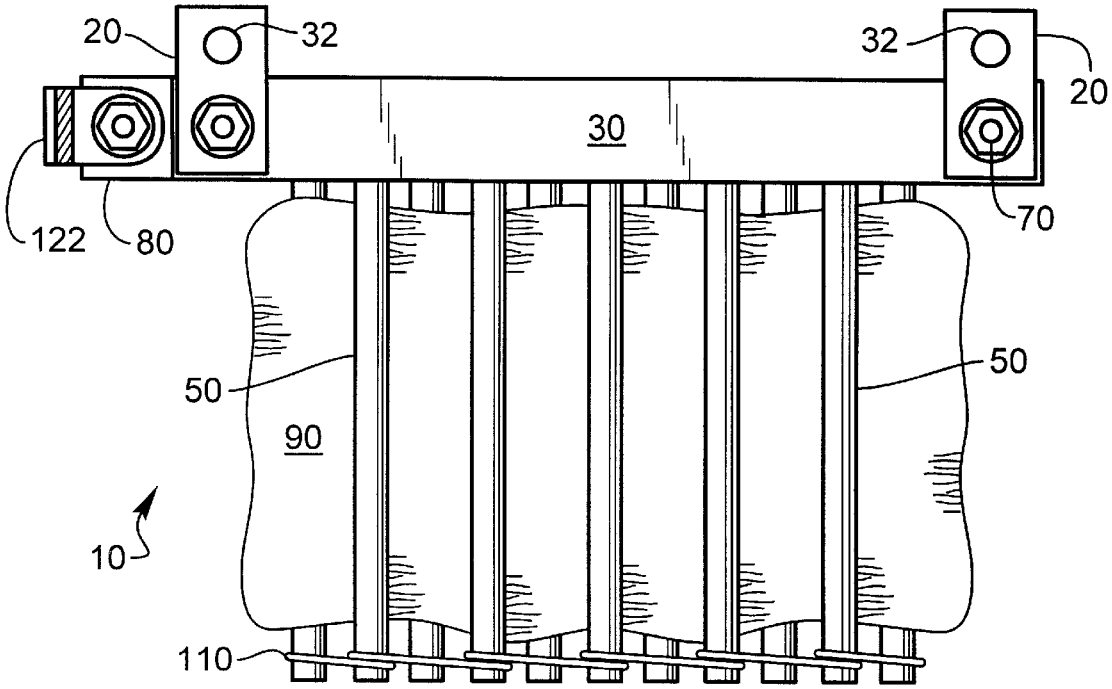
FIG. 6 is an elevation of the linear inert anode configuration shown in FIG. 5.

Referring now to FIG. 6, the elevation of linear module 10, earlier shown in plan view in FIG. 5, is illustrated. Module 10 is suspended by suspension attachments 20 connected to outer clamping bars 30 with bolt holes 60 accommodating bolt fasteners 70 (not shown). Wires 50 with their upper ends compressed and held by all clamping bars, as shown in FIG. 5, extend downward parallel to each other. To maintain wires 50 in a parallel position an all-embracing retaining wire 110 is properly wrapped around all wires 50.

Figure 7:
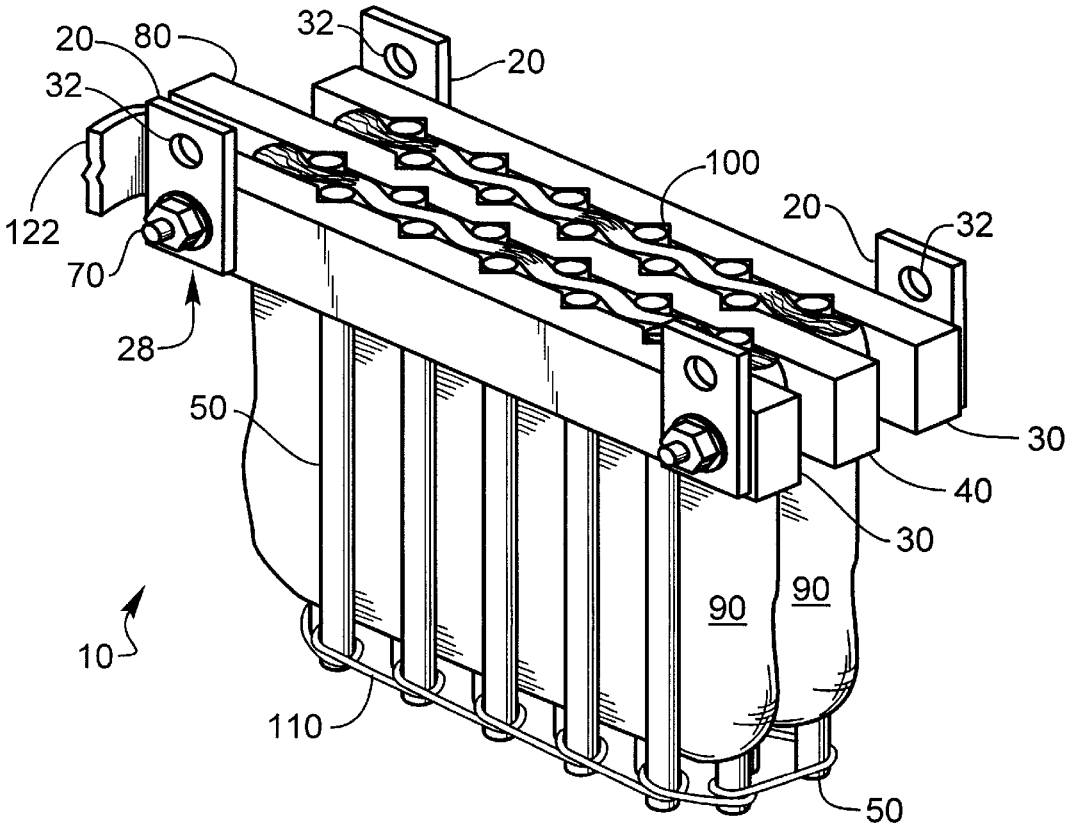
FIG. 7 is a pictorial front view of the linear inert anode configuration of FIG. 6 showing a modular design.

Referring now to FIG. 7, a pictorial view of the elevation of a three-dimensional linear module 10 is shown, with the same callouts and a three-dimensional retaining wire in place.

Figure 8:
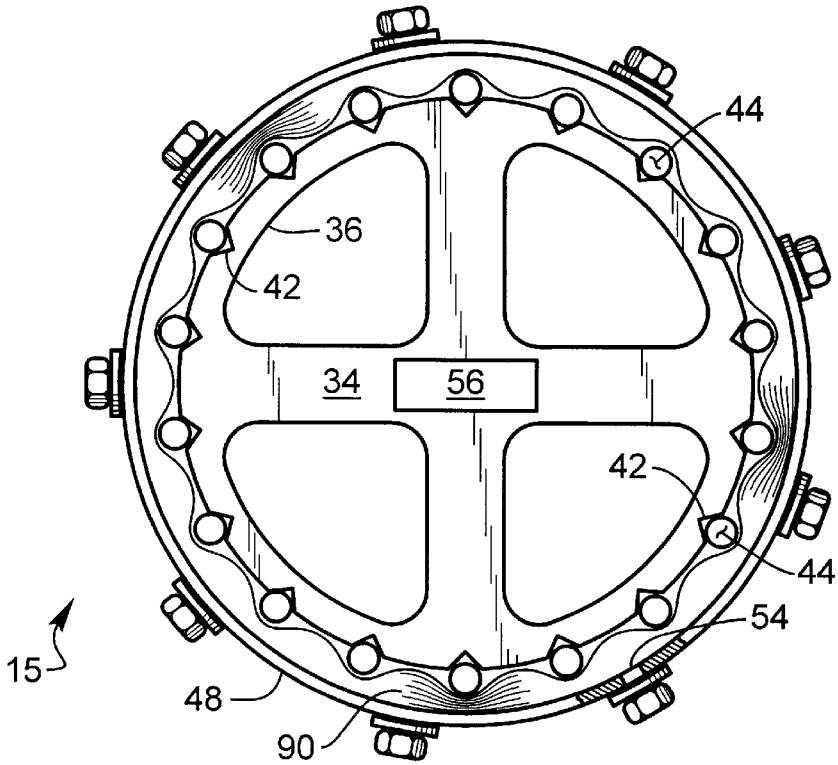
FIG. 8 is a plan view of the circular configuration of the inert anode of the invention showing a single cylindrical design.
Figure 9:
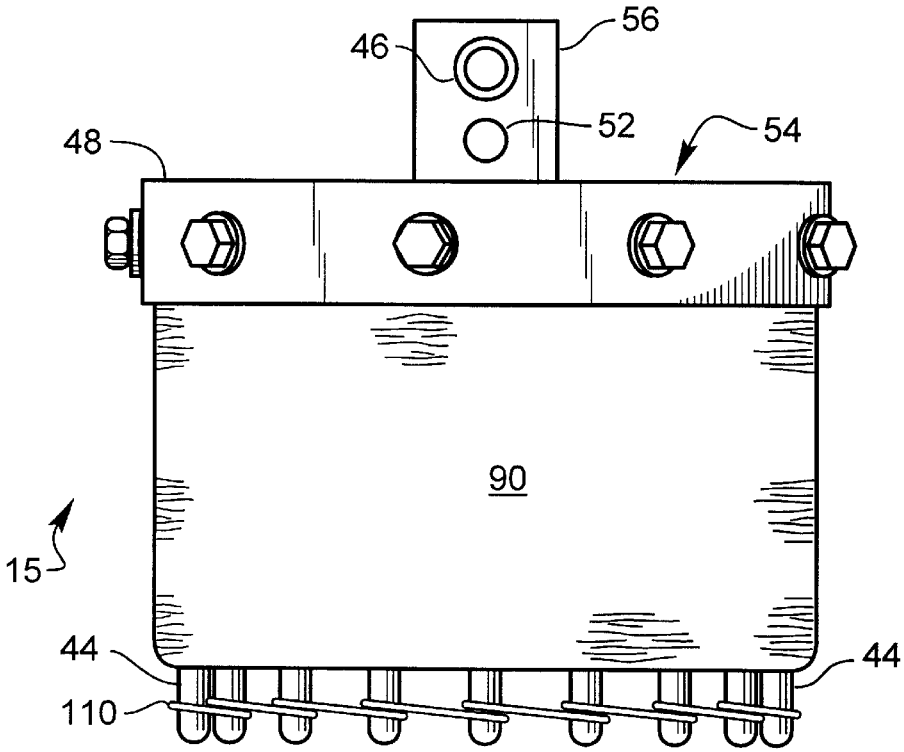
FIG. 9 is an elevation of the circular inert anode configuration shown in FIG. 8.
Figure 10:
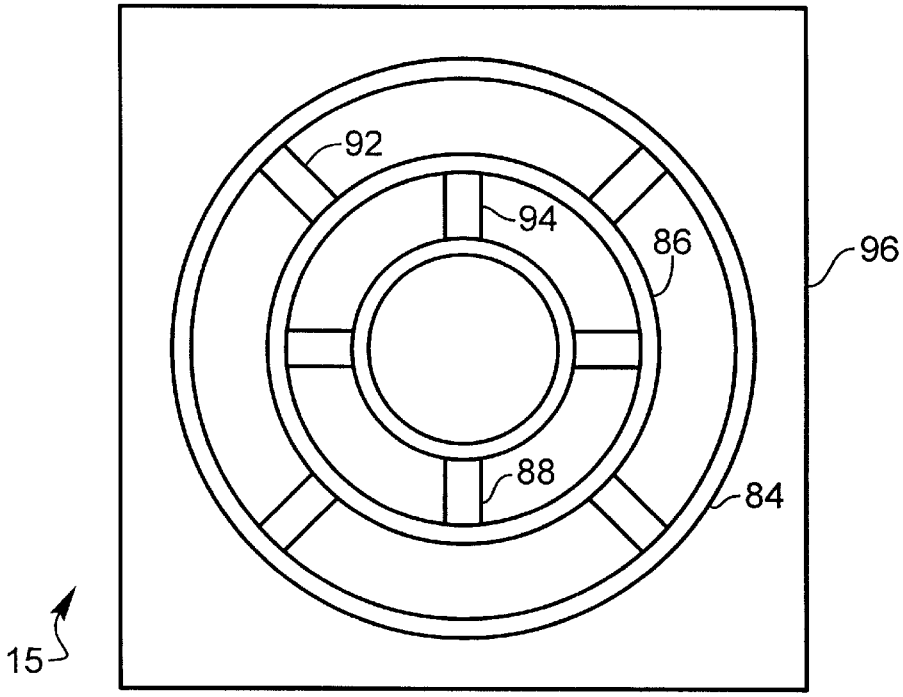
FIG. 10 is a plan view schematic of a multiple concentric design of the circular inert anode configuration shown in FIG. 8.

Referring now to FIGS. 8–10, circular anode configurations are illustrated. FIG. 8 is a plan view of a circular anode configuration 15 in a single cylindrical design. Here vertical noble-metal coated rods 44 are arranged in parallel around the outer circumference of an inner casting rim 36 which is kept rigid by a cruciform central bracing 34. Inner casting rim 36 also carries positioning notches 42 on its outside, one opposite each rod 44.

A central hub 56 with support connection 46 (see FIG. 9) is affixed to bracing 34 whereby circular configuration 15 is suspended. Hub 56 also receives electrical power input through power connection 52 (see FIG. 9) To firmly secure rods 44 to rim 36 a circumferential compressible wire mesh 90 completely surrounds rods 44. To produce complete electrical contact among all metallic parts, a circular metallic outer band strip 48 is tightened around mesh 90 using a number of compression fastening holes 54 in strip 48, This also urges rods 44 into their designated casting rim notches 42. In this way the electric current introduced through power connection 52 flows to the extreme reaches of rods 44 ansd into the electrolyte.

Referring now to FIG. 9, an elevation of the circular configuration 15 shown in plan view in FIG. 8 is illustrated. Hub 56 receives power connection 52 and carries support connection 46. Outer band strip 48 with compression fastening holes 54 secures the upper ends of rods 44, and retaining wire 110 at the lower extremities of rods 44 ensures that all rods 44 are vertical and parallel to each other.

Referring now to FIG. 10, a plan view schematic of a multiple concentric design of circular anode configuration 15 is shown. A three-ring configuration is located within a typically square furnace perimeter 96. An inner ring 88, an intermediate ring 86 and an outer ring 84 are connected by staggered inner radials 94 and outer radials 92. Compressed noble-metal coated rods (not shown) as in FIG. 8 extend downward from all rings and radials to provide a uniform coverage of the furnace plan area.

Figure 11:
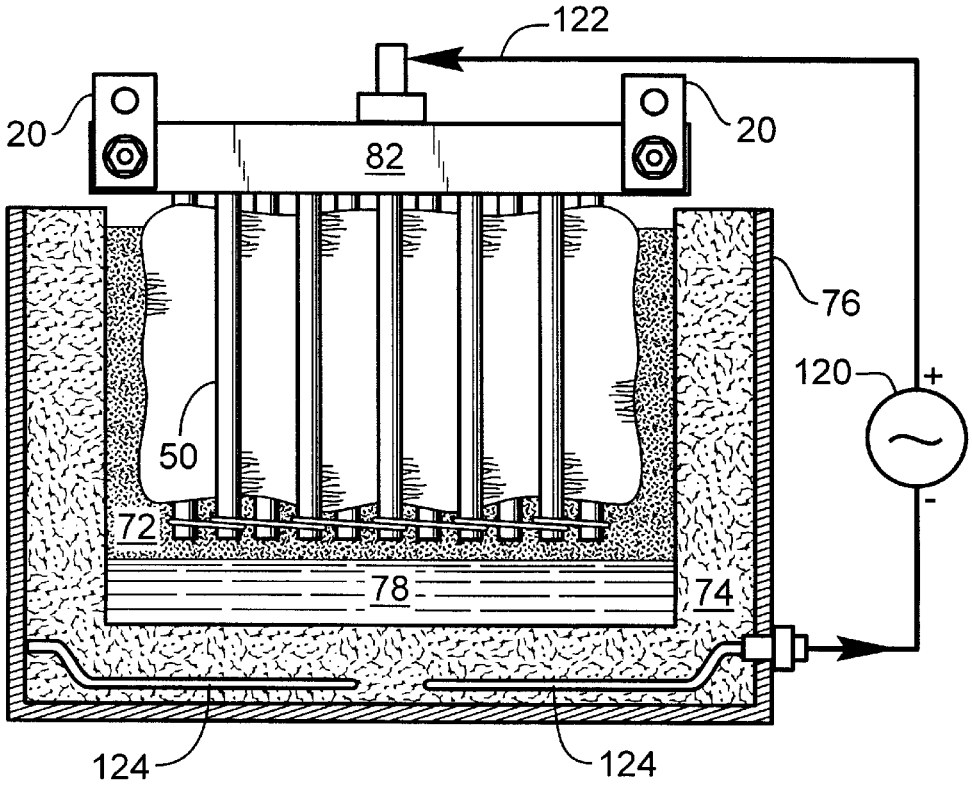
FIG. 11 is a schematic of a typical electrolytic furnace for aluminum production making use of an inert anode configuration of the invention.

Referring now to FIG. 11, there is shown a schematic of a typical electrolytic furnace for aluminum production making use of an inert anode configuration of the invention. The furnace outer wall is typically a steel shell 76 lined with a metallic cathode 74. Anode bus and support 82 is suspended from an external overhead fixture by suspension attachments 20.

Noble-metal coated wires or rods 50 extend vertically from bus 82 into fused cryolite bath 72. Electrical power input 120 connects to bus 82 causing current flow through anode wires or rods 50 to electrolyte 72 . The electrolysis produces molten aluminum 78 which is tapped off (not shown) adjacent to cathode 74 and the electrical circuit is completed via steel bar current collectors 124 in cathode 74 and the external return conductor 122.

As will be apparent to those skilled in the art, numerous modifications and variations of the present invention are possible in light of the above teaching. For example, noble-metal coated inert anodes may be constructed in geometries differing from the embodiments disclosed here. It is to be understood, therefore, that the invention may be practiced otherwise than as specifically described herein within the scope of the appended claims.

I claim:

1. An inert anode for use in an electrolytic furnace for the production of aluminum from the ore, said anode comprising:

an essentially horizontal support structure with a connection to an electrical power source, said support structure being attached to an external overhead fixture;

a plurality of essentially vertical elongated members attached at an upper extremity to said support structure by an attachment means, said elongated members constructed of a high-temperature corrosion-resistant alloy; and a durable high-melting-point noble-metal coating with catalytic properties deposited on all surfaces of said plurality of elongated members;

wherein said support structure, said attachment means, said elongated members and said noble-metal coating all are made of electrically conducting materials to enable current from the electrical power source to flow to said all surfaces of said plurality of elongated members;

whereby inert-anode electrolytic aluminum production results from positioning said support structure so that said noble-metal coated plurality of elongated members is immersed as completely as possible in the electrolyte bath of the electrolytic furnace, with said immersed elongated members and noble-metal coatings remaining intact due to adequate structural integrity and catalytic surface properties at a temperature of said electrolyte bath.

2. The inert anode of claim 1 wherein said high-temperature corrosion-resistant alloy is an alloy selected from the group consisting of ASTM A297, ASTM A351 and AISI 330.

3. The inert anode of claim 1 wherein said durable noble-metal coating is a platinum coating.

4. The inert anode of claim 1 wherein further said durable noble-metal coating is deposited by the SCX sputter coating process.

5. The inert anode of claim 1 wherein further said durable noble-metal coating has a thickness in the range from about 1 to about 10 microns.

6. The inert anode of claim 1 wherein said elongated members are wires.

7. The inert anode of claim 1 wherein said elongated members are rods.

8. The inert anode of claim 1 further comprising retaining wires disposed in an essentially horizontal plane near a lower extremity of said plurality of vertical elongated members to ensure a proper parallel spacing of said plurality of vertical elongated members.

9. The inert anode of claim 1 wherein said support structure is a number of essentially horizontal parallel clamping bars., said plurality of vertical elongated members is an array of staggered parallel linear rows of said vertical elongated members in plan view, with pairs of rows located between adjacent said clamping bars, and said attachment means comprise (a) rectangular compressible wire mesh pads placed between each said pair of rows of vertical elongated members and (b) a pair of bolt fasteners running through bolt holes in extremities of said number of clamping bars;

whereby tightening said bolt fasteners to bring said clamping bars closer together and thereby compressing said wire mesh pads between said clamping bars and between said pairs of rows of vertical elongated members results in a rigid attachment of said array of staggered linear rows of vertical elongated members to said number of horizontal clamping bars, and in electrical current flow from the electrical power source through said clamping bars and said compressed wire mesh pads to said pairs of rows of vertical elongated members.

10. The inert anode of claim 9 wherein said vertical elongated members are wires.

11. The inert anode of claim 1 wherein said horizontal support structure is a circular inner casting rim with a central bracing;

said plurality of vertical elongated members is a circular array of said vertical elongated members placed around the circumference of and contiguous to said inner casting rim; and said attachment means comprise (a) a circular compressible wire mesh pad placed around the circumference of and contiguous to said circular array of said vertical elongated members and (b) a circular outer band strip placed around said circular compressible wire mesh pad;

whereby tightening said outer band strip to compress said circular compressible wire mesh pad around said circular array of vertical elongated members and urging said circular array of vertical elongated members toward close contact with said inner casting rim results in a rigid attachment of said circular array of vertical elongated members to said inner casting rim, and in electrical current flow from the electrical power source through said inner casting rim and said compressed circular wire mesh pad to said circular array-of vertical elongated members.

12. The inert anode of claim 11 wherein said vertical elongated members are rods.

13. The inert anode of claim 11 further comprising a number of external rings concentric with and connected to the circular inner casting rim, said number of external rings accommodating additional said vertical elongated members.

14. The inert anode of claim 13 wherein said number of external rings is two, comprising an intermediate ring and an outer ring.

* * * * *